US011598337B2

(12) United States Patent
Choi et al.

(10) Patent No.: US 11,598,337 B2
(45) Date of Patent: Mar. 7, 2023

(54) COMPRESSOR WITH ENHANCED STIFFNESS AT CONTACT POINT BETWEEN FIXED AND ORBITING SCROLLS

(71) Applicant: LG Electronics Inc., Seoul (KR)

(72) Inventors: Jungsun Choi, Seoul (KR); Cheolhwan Kim, Seoul (KR); Sangbaek Park, Seoul (KR)

(73) Assignee: LG Electronics Inc., Seoul (KR)

( * ) Notice: Subject to any disclaimer, the term of this patent is extended or adjusted under 35 U.S.C. 154(b) by 107 days.

(21) Appl. No.: 16/926,042

(22) Filed: Jul. 10, 2020

(65) Prior Publication Data

US 2021/0010473 A1 Jan. 14, 2021

(30) Foreign Application Priority Data

Jul. 11, 2019 (KR) ..... 10-2019-0084097

(51) Int. Cl.

| | |
|---|---|
| ***F04C 18/02*** | (2006.01) |
| ***F01C 1/02*** | (2006.01) |
| ***F04C 23/00*** | (2006.01) |
| *F04C 27/00* | (2006.01) |

(52) U.S. Cl.

CPC ..... *F04C 18/0246* (2013.01); *F04C 23/008* (2013.01); *F04C 27/005* (2013.01); *F04C 2240/30* (2013.01)

(58) Field of Classification Search

CPC .. F04C 18/02; F04C 18/0246; F04C 18/0269; F01C 1/02; F01C 1/0246

See application file for complete search history.

(56) References Cited

U.S. PATENT DOCUMENTS

| | | | | |
|---|---|---|---|---|
| 8,308,460 | B2 * | 11/2012 | Seong | F04C 18/0269 418/150 |
| 2004/0067147 | A1 * | 4/2004 | Nakane | F04C 29/04 418/55.2 |
| 2008/0159894 | A1 * | 7/2008 | Kanemoto | F01C 1/0215 418/55.2 |
| 2016/0053759 | A1 * | 2/2016 | Choi | F04C 18/0269 418/55.2 |

FOREIGN PATENT DOCUMENTS

| | | | | |
|---|---|---|---|---|
| JP | 09053584 A | * | 2/1997 | F04C 18/0269 |
| JP | 4291098 B2 | * | 7/2009 | F04C 18/0269 |
| KR | 1020160022146 | | 2/2016 | |

OTHER PUBLICATIONS

English translation of JP-0905384 by J Piat Pat Nov. 5, 2021.*
English translation of JP-4291098 by J-PiatPat, Jul. 28, 2022.*
English translation of JP09053584 by J-PiatPAt, Jul. 28, 2022.*
Korean Office Action in Korean Application No. 10-2019-0084097, dated Sep. 3, 2020, 12 pages (with English translation).

* cited by examiner

*Primary Examiner* — Deming Wan
(74) *Attorney, Agent, or Firm* — Fish & Richardson P.C.

(57) ABSTRACT

A compressor, more particularly, a scroll compressor provides structures that may enhance centrifugal stiffness at a contact point between a fixed scroll and an orbiting scroll. The compressor may include an orbiting scroll having an orbiting scroll wrap wound around a radial-direction inner area from a radial-direction outer area; and a fixed scroll having a fixed scroll wrap wound around the radial-direction inner area from the radial-direction outer area. A surfacing part may be configured to narrow a distance between the orbiting scroll wrap and the fixed scroll wrap may be formed in a predetermined section of the orbiting scroll or fixed scroll wrap.

14 Claims, 6 Drawing Sheets

Crank Angle 170° (5 contact points)
5 contact points section : 0~260°

COMPRESSOR WITH ENHANCED STIFFNESS AT CONTACT POINT BETWEEN FIXED AND ORBITING SCROLLS

CROSS-REFERENCE TO RELATED APPLICATIONS

This application claims priority to Korean Patent Application No. 10-2019-0084097, filed on Jul. 11, 2019 in Korea, the entire contents of which is hereby incorporated by reference in its entirety.

TECHNICAL FIELD

Embodiments of the present disclosure relate to a compressor, more particularly, a scroll compressor that may enhance centrifugal stiffness at a contact point between a fixed scroll and an orbiting scroll.

BACKGROUND

Generally, a compressor is applied to a refrigerant compression type refrigeration cycle (hereinafter, a refrigeration cycle) such as a refrigerator and an air conditioner.

Such a compressor may be categorized based on a refrigerant compressing method into a reciprocating compressor and an orbiting scroll. The orbiting scroll includes a scroll compressor.

The scroll compressor may be categorized based on positions of a drive motor and a compression part into an upper compression type and a lower compression type. In the upper compression type, the compression part is positioned higher than the drive motor. In the lower compression type, the compression part is positioned lower than the drive motor.

Specifically, the compressor may be named differently based on the relative positions of the drive motor and the compression part. The compressor may be horizontally mounted, not vertically mounted. Accordingly, the compressor may be more generalized based on the relative positions of the drive motor and the compression part and named as general types. Based on the flow direction of the refrigerant in the compressor and the position of the drive motor, the compressor may be categorized into an upstream compressor and a downstream compressor. The upstream compressor may compress the refrigerant along the upstream with respect to the drive motor and discharge the refrigerant along the downstream with respect to the drive motor. The downstream compressor may compress the refrigerant along the downstream with respect to the drive motor and discharge it along the upstream with respect to the drive motor.

The scroll compressor may compress the refrigerant as the orbiting scroll is rotating on the fixed scroll. The fixed scroll and the orbiting scroll have a wrap from the outside to the inside with respect to a radial direction. The fixed scroll and the orbiting scroll may contact with each other based on an angle of the orbiting scroll rotating on the fixed scroll. The number of the contact points may be variable based on a section of the orbiting angles of the orbiting scroll.

The wrap thickness of the fixed scroll and the orbiting scroll may be variable with a preset profile. A contact area may increase more and more at a contact point between the fixed scroll and the orbiting scroll, as getting farther from the center of the scroll compressor such that the scroll compressor might be subject to the concentration of a centrifugal force.

Such the concentration of the centrifugal force occurring in an area where the wrap is thin might break the scroll disadvantageously. Especially, it is more likely that the wrap might be deformed and damaged in the area where the contact area is wide with a small number of wrap contact points during a high-speed operation.

Accordingly, there are increasing demands for an invention structured to prevent the damage to the area where the wrap of the fixed scroll and the orbiting scroll is thin

SUMMARY

Accordingly, an object of the present disclosure is to address the above-noted and other problems of the conventional scroll compressor.

Another object of the present disclosure is to provide a compressor that is safe with enhanced durability by enhancing reliability of a fixed scroll and an orbiting scroll.

A further object of the preset disclosure is to provide a compressor that may effectively prevent a centrifugal force from being concentrated on a fragile area of the wrap by applying minute change (a surfacing part) about the wrap thickness of a specific area of the conventional fixed scroll and/or orbiting scroll.

A still further object of the present disclosure is to provide a compressor that include a surfacing portion provided in an optimized position in consideration of the number of wrap contacts, the contact points and the centrifugal force ratio at the contact points based on an orbiting angle of the orbiting scroll.

A still further object of the present disclosure is to provide a compressor that may perform surfacing with the optimized thickness in consideration of the contact film thickness of the orbiting and fixed scrolls.

A further object of the present disclosure is to provide a compressor that may protect the orbiting scroll and/or fixed scroll by intentionally causing the concentration of the centrifugal force on a thick area of the orbiting scroll orbiting scroll wrap and/or fixed scroll fixed scroll wrap to reduce the concentration of the centrifugal force on a relatively thin area.

A still further object of the present disclosure is to provide a compressor that may enhance the reliability of the area in which wrap strength is weak by concentrating the centrifugal force on an area in which the wrap strength is advantageously strong.

A still further object of the present disclosure is to provide a compressor that may reduce the concentration of the centrifugal force by increasing a contact area between the orbiting scroll wrap and the fixed scroll wrap in the area having the weak wrap strength.

Particular implementations of the present disclosure described herein provide a compressor that includes an orbiting scroll, a fixed scroll, and a surfacing part. The orbiting scroll has an orbiting scroll wrap. The fixed scroll has a fixed scroll wrap. The surfacing part may be disposed at the orbiting scroll wrap or the fixed scroll wrap, and reduce a distance between the orbiting scroll wrap and the fixed scroll wrap.

In some implementations, the compressor may optionally have one or more of the following features. The distance between the orbiting scroll wrap and the fixed scroll wrap may be uniform except for an area including the surface part and areas at ends of the orbiting scroll wrap and the fixed scroll wrap. The orbiting scroll wrap and the fixed scroll wrap may have thicknesses that at least partially vary. The distance between the orbiting scroll wrap and the fixed scroll warp may be constant except for an area including the surfacing part. The orbiting scroll and the fixed scroll may be configured to make four or five contact points between the orbiting scroll wrap and the fixed scroll wrap based on the orbiting scroll orbiting with respect to the fixed scroll. The surfacing part may be disposed at one of the contact points. An orbiting angle of the orbiting scroll may have (i) a first range in which the four contact points are made between the orbiting scroll wrap and the fixed scroll wrap and (ii) a second range in which the five contact points are made between the orbiting scroll wrap and the fixed scroll wrap. A contact area at one of the contact points that is located closer, in a radial direction, to an outermost area than the other contact points is larger than contact areas at the other contact points. The surfacing part may be disposed at one of the contact points that is located at an innermost area in the radial direction. The second range of the orbiting angle of the orbiting scroll may be from 0 degree to 260 degree. The first range of the orbiting angle of the orbiting scroll may be from 270 degrees to 350 degrees. The surfacing part may be disposed at one of the four contact points based on the orbiting angle being in the first range. One of the four contact points that is located, in a radial direction, at an outermost area may have a largest contact area of the four contact points. The surfacing part may be disposed at one of the four contact points except for a first contact point. The first contact point may have a largest contact area of the four contact points. The surfacing part may be disposed at one of the four contact points that has a smallest contact area of the four contact points. The surfacing part may have a thickness that is smaller than a thickness of a lubricant film that is disposed at the contact points between the orbiting scroll wrap and the fixed scroll wrap. The thickness of the surfacing part may be half or less than half of the thickness of the lubricant film. Based on the thickness of the lubricant film being 20 μm, the thickness of the surfacing part may be less than 10 μm. The surfacing part may be disposed at either the fixed scroll wrap or the orbiting scroll wrap. The surfacing part may be disposed at both the fixed scroll wrap and the orbiting scroll wrap, and the surfacing part of the fixed scroll wrap may contact the surfacing part of the orbiting scroll wrap based on orbiting of the orbiting scroll. A contact area of a first contact point between the fixed scroll wrap and the orbiting scroll wrap through the surfacing part may be larger than a contact area of a second contact point where the fixed scroll wrap directly contacts the orbiting scroll wrap. The contact area of the second contact point may be smaller than the contact area of the first contact point.

Embodiments of the present disclosure may provide a compressor comprising an orbiting scroll having an orbiting scroll wrap wound around a radial-direction inner area from a radial-direction outer area; and a fixed scroll having a fixed scroll wrap wound around the radial-direction inner area from the radial-direction outer area, wherein a surfacing part configured to narrow a distance between the orbiting scroll wrap and the fixed scroll wrap is formed in a predetermined section of the orbiting scroll or fixed scroll wrap.

A plurality of contact points may be formed between the orbiting scroll wrap and the fixed scroll wrap. Especially, the contact points may be formed on the same center line with respect to a center of a shaft.

Accordingly, a specific contact point having the surfacing part may reduce a contact area and centrifugal force concentration at the other contact points.

The distance between the orbiting scroll wrap and the fixed scroll wrap may be uniform except end areas of the orbiting scroll wrap and the fixed scroll wrap and the area having the surfacing part.

The orbiting scroll wrap and the fixed scroll wrap may have a predetermined profile that varies the thicknesses and maintains the uniform distance, and the surfacing part may be formed to exclude the predetermined profile.

Four or five contact points may be formed between the orbiting scroll wrap and the fixed scroll wrap, as the orbiting scroll is eccentrically orbiting with respect to the fixed scroll.

The surfacing part may be formed one of the contact points.

An orbiting angle section having the four contact points and an orbiting angle section having the five contact points may be formed.

A contact area at a contact point that is located closer to the radial-direction outermost area may be larger.

The surfacing part may be formed in the contact point that is provided in the radial-direction innermost area out of the contact points.

The contact points may be five in an orbiting angle section of the orbiting scroll from 0 degree to 260 degree, and the contact points may be four in an orbiting angle section of the orbiting scroll from 270 degrees to 350 degrees.

The surfacing part may be formed one contact point in the section having the four contact points.

Contact areas at the four contact points may be the largest at the contact point that is located in a radial-direction outermost area. The surfacing part may be formed in the other ones of the four contact points, except the one having the largest contact area. The surfacing part may be formed in one of the four contact points that has the smallest contact area.

The thickness t1 of the surfacing part may be smaller than the thickness t of a lubricant film at the contact points between the orbiting scroll wrap and the fixed scroll wrap.

The thickness t1 of the surfacing part may be 0.5 t or less.

When the thickness t of the lubricant film is 20 μm, the thickness t1 of the surfacing part may be more than 0 μm and 10 μm or less.

The surfacing part may be formed in the fixed scroll wrap or the orbiting scroll wrap.

The surfacing part may be formed in both the fixed scroll wrap and the orbiting scroll wrap, and the surfacing part of the fixed scroll wrap and the surfacing part of the orbiting scroll wrap form a contact point when the orbiting scroll is orbiting.

A contact area when the contact point between the fixed scroll wrap and the orbiting scroll wrap is formed with the surfacing part may be larger than a contact area when the contact point is formed without the surfacing part.

When the contact point is formed in the surfacing part, a contact area at the other contact points may be smaller or the contact is excluded.

Embodiments of the present discloser may also provide a scroll compressor comprising a case; a drive motor comprising a stator mounted in the case and a rotor rotatably mounted in a radial-direction inner area of the stator; a centrifugation space defined by a downstream side of the drive motor provided in the case and the case and configured to centrifugate a compressed refrigerant from a lubricant oil; a discharge pipe provided in the case and configured to discharge the refrigerant held in the centrifugation space to the outside of the case; a shaft rotatably coupled to the rotor; a compression part provided in an upstream side of the drive motor and configured to compress the refrigerant by means of the rotation of the shaft. At this time, a surfacing part having an intentionally reduced orbiting radius may be formed in a predetermined section of a fixed scroll wrap and an orbiting scroll wrap. In other words, the surfacing part formed to intentionally have a smaller orbiting radius than a uniform orbiting radius in the other sections may be provided.

When a contact point is formed in the surfacing part, a contact area may increase. Contact areas in the other contact points that are formed on the same center line with the surfacing part may decrease. Accordingly, centrifugal force concentration may increase at a contact point formed in the surfacing part between the orbiting scroll wrap and the fixed scroll wrap. The centrifugal force concentration may decrease at the other contact points. Accordingly. The centrifugal force concentration may be intentionally changed at a specific location by varying the position of the surfacing part.

According to the embodiment of the present disclosure, the present disclosure has the effect of providing a compressor that is safe with enhanced durability by enhancing reliability of a fixed scroll and an orbiting scroll.

In addition, the present disclosure has the effect of providing a compressor that may effectively prevent a centrifugal force from being concentrated on a fragile area of the wrap by applying minute change about the wrap thickness of a specific area of the conventional fixed scroll and/or orbiting scroll.

In addition, the present disclosure has the effect of providing a compressor that include a surfacing portion provided in an optimized position in consideration of the number of wrap contacts, the contact points and the centrifugal force ratio at the contact points based on an orbiting angle of the orbiting scroll.

In addition, the present disclosure has the effect of providing a compressor that may perform surfacing with the optimized thickness in consideration of the contact film thickness of the orbiting and fixed scrolls.

In addition, the present disclosure has the effect of providing a compressor that may protect the orbiting scroll and/or fixed scroll by intentionally causing the concentration of the centrifugal force on a thick area of the orbiting scroll wrap and/or fixed scroll wrap to reduce the concentration of the centrifugal force on a relatively thin area.

In addition, the present disclosure has the effect of providing a compressor that may enhance the reliability of the area in which wrap strength is weak by concentrating the centrifugal force on an area in which the wrap strength is advantageously strong.

In addition, the present disclosure has the effect of providing a compressor that may reduce the concentration of the centrifugal force by increasing a contact area between the orbiting scroll wrap and the fixed scroll wrap in the area having the weak wrap strength.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and reference numerals means structural elements and wherein.

DETAILED DESCRIPTION

Hereinafter, referring to the accompanying drawings, exemplary embodiment of a compressor according to the present disclosure will be described.

First of all, referring to FIG. 1, a compressor that may be applied to one embodiment of the present disclosure will be described in detail.

Figure 1:
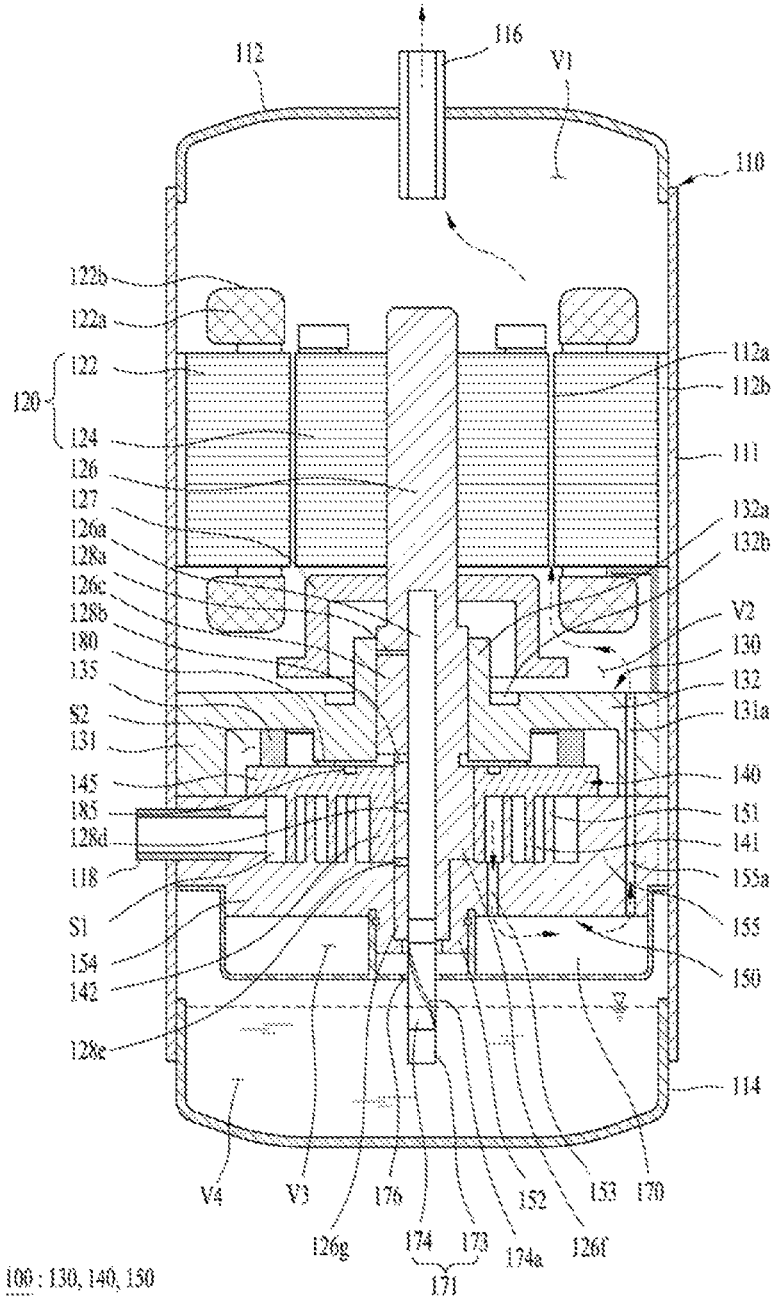
FIG. 1 is a sectional diagram illustrating one example of a compressor that may be applied to one embodiment of the present disclosure.

FIG. 1 is a sectional diagram illustrating one example of a compressor that may be applied to one embodiment of the present disclosure. A compression part is provided under a drive motor in the compressor shown in the drawing such that the compressor may be a lower compression type compressor or an upper stream compressor.

For easy description sake, upper and lower areas may be described with respect to the compressor that is installed vertically. Upper and lower stream areas may be described with respect to flow of a refrigerant and a position of a drive motor 120. In the same compressor, the term of "upper" may mean "downstream" and the term of "down" may mean "upstream".

The compressor according to the present disclosure may include a case 110, a drive motor 120, a compression part 100 and a shaft 126.

The case 110 may be formed to have an inner space. As one example, an oil storage may be provided in a lower area of the case 110. Such an oil storage may mean a fourth space V4 which will be described later. In other words, the fourth space V4 which will be described later may be formed as the oil storage.

In addition, a refrigerant discharge pipe 116 may be provided in an upper area of the case to discharge the compressed refrigerant.

Specifically, the inner space of the case 110 may include a first pace V1 defined above the drive motor 120; a second space V2 defined between the drive motor 120 and the compression part 100; a third space V3 partitioned off by a discharge cover 170 which will be described later; and a fourth space V4 arranged under the compression part 100.

The case 110 may be formed in a cylinder shape. As one example, the case 110 may include a cylindrical shell 111 having an open top and an open bottom.

An upper shell 112 may be installed in an upper area of the cylindrical shell 111 and a lower shell 114 may be installed in a lower area of the cylindrical shell 111. The upper and lower shells 112 and 114 may be coupled to the cylindrical shell 111 by welding to define the inner space.

The refrigerant discharge pipe 116 may be installed in the upper shell 112 and the refrigerant compressed in the compression part 100 may be discharged outside through the refrigerant discharge pipe 116. As one example, the refrigerant compressed in the compression part 100 may sequentially pass through the third space V3, the second space V2 and the first space V1, and then discharged outside through the refrigerant discharge pipe 116.

An oil separator or an oil recovery system that are connected with the conventional compressor as general elements are not shown in FIG. 1. That means that the compressor according to the embodiment of the present disclosure is capable of separating oil effectively enough not to require an auxiliary oil separator.

The lower shell 114 may define the fourth space V4 provided as the oil storage for storing oil. The fourth space V4 may function as an oil chamber for supplying oil to the compression part 100 so as to facilitate the smooth operation of the compressor.

In addition, a refrigerant suction pipe 118 provided as a path for drawing the refrigerant may be installed in a side surface of the cylindrical shell 111. The refrigerant suction pipe 118 may be installed along a side surface of a fixed scroll 150, which will be described later, to a compression chamber S1.

The drive motor 120 may be installed in the case 110. As one example, the drive motor 120 may be arranged higher than the compression part 100 in the case 110.

The drive motor 120 may include a stator 122 and a rotor 124. As one example, the stator 122 may be formed in a cylinder shape and secured to the case 110. A coil 122*a* may be wound around the stator 122. A refrigerant path groove 112*a* configured to allow the refrigerant or oil discharged from the compression part 100 to pass there through may be formed between an outer circumferential surface of the rotor 124 and an inner circumferential surface of stator 122. In other words, the refrigerant path groove 112*a* may be partitioned off by the inner circumferential surface of the stator 122 and the outer circumferential surface of the rotor 124.

The rotor 124 may be arranged in an inner area with respect to a radial direction of the stator 122 and configured to generate a rotational power. In other words, the shaft 126 may penetrate the center of the rotor 124 and rotate together with the shaft 126. The rotational power generated by the rotor 124 may be transferred to the compression part 100 through the shaft 126.

The compression part 100 may be coupled to the drive motor 120 and configured to compress the refrigerant. The shaft 126 may penetrate the compression part 100 connected with the drive motor 120.

The compression part 100 may include a shaft support part that is projected upwardly and downwardly. The shaft 126 may penetrate at least predetermined area of the shaft support part. As one example, the shaft support part may include a first shaft support part projected upwardly and a second shaft support part projected downwardly, which will be described later.

The compression part 100 may include a main frame 130, a fixed scroll 150 and an orbiting scroll 140.

Specifically, the compression part 100 may further include an Oldham's ring 135. The Oldham's ring 135 may be installed between the orbiting scroll 140 and the main frame 130. Also, the Oldham's ring 135 may be configured to prevent the rotating movement of the orbiting scroll 140 and facilitate the orbiting movement of the orbiting scroll 140 on the fixed scroll 150.

The main frame 130 may be provided under the drive motor and to form a top of the compression part 100.

The main frame 130 may include a frame end plate 132 having an approximately-rounded shape (hereinafter, "a first end plate); a frame shaft support part 132*a* (hereinafter, "a first shaft support part") provided in the center of the first end plate 132 and to allow the shaft 126 to pass there through; and a frame side wall (hereinafter, "a first side wall") projected from an outer circumference of the first end plate 132 downwardly.

The first side wall 131 may have an outer circumference that is in contact with an inner circumferential surface of the cylindrical shell 111 and a lower end that is in contact with an upper end of a fixed scroll side wall 155 which will be described later.

The first side wall 131 may include a frame discharge hole 131*a* that is formed through the inside of the first side wall 131 along an axial direction to form a refrigerant path. The frame discharge hole 141*a* may have an inlet that is in communication with an outlet of the fixed scroll discharge hole 155*a* which will be described later and an outlet that is in communication with the second space V2. The frame discharge hole 131*a* and the fixed scroll discharge hole 155*a* that are in communication with each other may be second discharge holes 131*a* and 155*a*.

A plurality of frame discharge holes 131*a* may be provided along a rime of the fixed scroll 150, corresponding to the frame discharge hole 131*a*.

The first shaft support part 132*a* may be projected from an upper surface of the first end plate 132 towards the drive motor 120. A first bearing may be provided in the first shaft support part 132*a* and a main bearing of the shaft 126, which will be described later, may penetrate the first bearing.

In other words, the first shaft support part 132*a* may penetrate the center of the main frame 130 along the axial direction and have the main bearing 126*c* of the shaft 126 composing the first bearing to be rotatably inserted therein.

An oil pocket 132*b* may be formed in the upper surface of the first end plate 132 and configured to collect the oil discharged between the first shaft support part 132*a* and the shaft 126.

The oil pocket 132*b* may be recessed from the upper surface of the first end plate 132 and formed in an annular shape along a rim of the first shaft support part 132*a*. In addition, a back-pressure chamber S2 may be formed in a lower surface of the main frame 130 to form a predetermined space together with the fixed scroll 150 and the orbiting scroll 140 and then support the orbiting scroll 140 by means of the pressure of the space.

In addition, the back-pressure chamber S2 may include a middle pressure area (in other words, a middle pressure chamber) and an oil supply path 126*a* provided in the shaft 126 may have a high-pressure area having a higher pressure than the pressure of the back-pressure chamber S2.

To divide the high-pressure area and the middle pressure area, a back-pressure seal 180 may be provided between the main frame 130 and the orbiting scroll 140. The back-pressure seal 180 may be provided as a sealing member, as one example.

The main frame 130 may form a predetermined space in which the orbiting scroll 140 coupled to the fixed scroll 150 is capable of orbiting.

The fixed scroll 150 may be provided in a lower area of the main frame 130. In other words, the fixed scroll 150 composing the first scroll may be secured to a lower surface of the main frame 130.

The fixed scroll 150 may include a fixed scroll end plate 154 (hereinafter, "the second end plate"); a fixed scroll side wall 155 (hereinafter, "a second side wall") projected from an outer circumference of the second end plate 154 upwardly; a fixed scroll wrap 151 projected from an upper surface of the second end plate 154 and forming a pressure chamber S1 by engaging with an orbiting scroll wrap 141 of the orbiting scroll 140 which will be described later; and a fixed scroll shaft support part 152 (hereinafter, "a second shaft support part") formed in a rear surface center of the second end plate 154 and having the shaft 126 to pass there through.

The compression part 100 may include a first discharge hole 153 configured to discharge the compressed refrigerant to a discharge cover 170; and a second discharge hole 131*a* and 155*a* spaced apart from the first discharge hole 153 to an outer area with respect to a radial direction of the compression part 100 and configured to guide the compressed refrigerant towards the refrigerant discharge pipe 116, which is described above.

Specifically, the first discharge hole 153 may be formed in the second end plate 154 and guide the compressed refrigerant from the compression chamber S1 towards the inner space of the discharge cover 170. In addition, the position of the first discharge hole 153 may be freely preset in consideration of the required discharge pressure.

As the first discharge hole 153 is directed towards the lower shell 114, the discharge cover 170 may be coupled to the lower surface of the fixed scroll 150 to guide the refrigerant discharged from the compression part towards a fixed scroll discharge hole 155*a* which will be described later.

The discharge cover 170 may be sealedly coupled to a lower end of the compression part 100. The discharge cover 170 may be formed to guide the refrigerant compressed in the compression part 100 towards the refrigerant discharge pipe 116.

As one example, the discharge cover 170 may be sealedly coupled to a lower surface of the fixed scroll 150 to separate the discharge path of the refrigerant from the fourth space V4.

The discharge cover 170 may include a through-hole 176 coupled to a sub bearing 126*g* of the shaft 126 and having an oil feeder 171 to pass there through. The oil feeder 171 may be partially submerged in the oil stored in the fourth space V4 of the case 110.

Meanwhile, the second side wall 155 may include a fixed scroll discharge hole 155*a* configured to form the refrigerant path through the inside of the second side wall 155 along the axial direction, together with the frame discharge hole 131*a*.

The fixed scroll discharge hole 155*a* may be corresponding to the frame discharge hole 131*a*. The fixed scroll discharge hole 155*a* may have an inlet that is in communication with the inner space of the discharge cover 170 and an outlet that is in communication with an inlet of the frame discharge hole 131*a*.

The fixed scroll discharge hole 155*a* and the frame discharge hole 131*a* may allow the third space V3 and the second space V2 to communicate with each other so as to guide the refrigerant discharged into the inner space of the discharge cover 170 from the compression chamber S1 towards the second space V2.

The refrigerant suction pipe 118 may be installed in the second side wall 155 to be in communication with an inlet of the compression chamber S1. In addition, the refrigerant suction pipe 118 may be spaced apart from the fixed scroll discharge hole 155*a*.

The second shaft support part 152 may be projected from the lower surface of the second end plate 154 towards the fourth space V4. In addition, the second shaft support part 152 may include a second bearing having the sub bearing 126*g* of the shaft 126 to be inserted therein.

The second shaft support part 152 may bend towards the center of the shaft to allow a lower end to support a lower end of the sub bearing 126*g* so as to form a thrust bearing surface.

The orbiting scroll 140 may be arranged between the main frame 130 and the fixed scroll 150 and form the second scroll.

Specifically, the orbiting scroll 140 may be coupled to the shaft 126 and configured to form a pair of compression chambers S1 with the fixed scroll 150, while orbiting.

The orbiting scroll 140 may include an orbiting scroll end plate 145 having an approximately circular shape (hereinafter, "a third end plate); an orbiting scroll wrap 141 projected from a lower surface of the third end plate 145 and configured to engage with the fixed scroll wrap 151; and a shaft coupling portion 142 provided in the center of the third end plate 145 and rotatably coupled to an eccentric portion of the shaft 126.

An outer circumference of the third end plate 145 may be provided in an upper end of the second side wall 155 and a lower end of the orbiting scroll wrap 141 may be supported by the fixed scroll 150, in a state of closely contacting with an upper surface of the second end plate 154.

In this instance, a pocket groove 185 may be formed in an upper surface of the orbiting scroll 140 and configured to guide the oil discharged through oil holes 128*a*, 128*b*, 128*d* and 128*e* towards the middle pressure chamber.

Specifically, the pocket groove 185 may be recessed from an upper surface of the third end plate 145. In other words, the pocket groove 185 may be formed in the upper surface of the third end plate 145 between the back-pressure seal 180 and the shaft 126.

As shown in the drawing, one or more pocket grooves 185 may be formed in respective both sides of the shaft 126. The pocket groove 185 may be formed between the back-pressure seal 180 and the shaft 126, while formed in the upper surface of the third end plate 145 in an annular shape with respect to the shaft 126.

The outer circumference of the shaft coupling portion 142 may be connected with the orbiting scroll wrap 141 and form the compression chamber S1, together with the fixed scroll wrap 151 during the compression process.

The fixed scroll wrap 151 and the orbiting scroll wrap 141 may be formed in a similar shape to an involute type. The involute type means a curve that is a locus drawn by an end of a thread unwinding from a foundation having a predetermined radius.

An eccentric portion 126*f* of the shaft 126 may be inserted in the shaft coupling portion 142. The eccentric portion 126*f* inserted in the shaft coupling portion 142 may be overwrapped with the orbiting scroll wrap 141 or the fixed scroll wrap 151 in a radial direction of the compressor.

In this instance, the radial direction may mean a direction (in other words, a horizontal direction) that is orthogonal to the axial direction (in other words, the vertical direction).

When the eccentric portion 126*f* of the shaft 126 is overwrapped with the orbiting scroll wrap 141 in the radial direction after penetrating the third end plate 145 as mentioned above, the repulsive force and the compressing force of the refrigerant may be applied to the same plane with respect to the third end plate 145 and the forces may somewhat cancel each other.

In addition, the shaft 126 may be coupled to the drive motor 120 and include an oil supply path 126*a* configured to guide the oil stored in the fourth space V4 to the upper area.

Specifically, the shaft 126 may have an upper end that is insertedly coupled to the center of the rotor 124 and a lower end that is coupled to the compression part 100 to support it in a radial direction.

The shaft 126 may transfer the rotational power of the drive motor 120 to the orbiting scroll 140 of the compression part 100. Accordingly, the orbiting scroll 140 eccentrically coupled to the shaft 126 may orbit with respect to the fixed scroll 150.

A main bearing 126*c* may be formed in a lower area of the shaft 126 to be inserted in the first shaft support part 132*a* and radially supported by the first shaft support part 132*a*. In addition, a sub bearing 126*g* may be formed in a lower area of the main bearing 126*c* to be inserted in the second shaft support part 152 of the fixed scroll 150 and radially supported by the second shaft support part. An eccentric portion 126*f* may be formed between the main bearing 126*c* and the sub bearing 126*g* to be inserted in the shaft coupling portion 142 of the orbiting scroll 140.

The main bearing 126*c* may be formed on a coaxial line to have the same axial center with the sub bearing 126*g*. The eccentric portion 126*f* may be eccentric with respect to the main bearing 126*c* or the sub bearing 126*g* in a radial direction.

An outer diameter of the eccentric portion 126*f* may be smaller than an outer diameter of the main bearing 126*c* and larger than an outer diameter of the sub bearing 126*g*. In this instance, it is more advantageous in coupling the shaft 126 to the respective shaft support parts 132*a* and 152 through the shaft coupling portion 142.

An oil supply path 126*a* may be formed in the shaft 126 and configured to supply the soil stored in the fourth space V4 provided as the oil storage to the outer circumferential surface of each bearing 126*c* and 126*g* and an outer circumferential surface of the eccentric portion 126*f*. Oil holes 128*a*, 128*b*, 128*d* and 128*e* may be formed in the bearing 126*c* and 126*g* and the eccentric portions 126*f* of the of the shaft 126, while penetrating outwardly with respect to a radial direction of the shaft 126 from the oil supply path 126*a*.

Specifically, the oil holes may include a first oil hole 128*a*, a second oil hole 128*b*, a third oil hole 128*d* and a fourth oil hole 128*e*.

First of all, the first oil hole 128*a* may be formed through the outer circumferential surface of the main bearing 126*c*. The first oil hole 128*a* may penetrate the outer circumferential surface of the main bearing 126*c* from the oil supply path 126*a*.

As another example, the first oil hole 128*a* may be formed through an upper area of the outer circumferential surface of the main bearing 126*c* but the embodiment of the present disclosure is not limited thereto. When the first oil hole 128*a* include a plurality of holes, each hole may be formed only in an upper or lower area of the outer circumferential surface of the main bearing 126*c* or the upper and lower areas, respectively.

The second oil hole 128*b* may be formed between the main bearing 126*c* and the eccentric portion 126*f*. Different from what is shown in the drawings, the second oil hole 128*b* may include a plurality of holes.

The third oil hole 128*d* may be formed through the outer circumferential surface of the eccentric portion 126*f*. Specifically, the third oil hole 128*d* may be formed through the outer circumferential surface of the eccentric portion 126*f* from the oil supply path 126*a*.

The fourth oil hole 128*e* may be formed between the eccentric portion 126*f* and the sub bearing 126*g*.

The oil guided to the upper area along the oil supply path 126*a* may be discharged through the first oil hole 128*a* and supplied to an entire area of the outer circumferential surface of the main bearing 126*c*.

In addition, the oil guided to the upper area along the oil supply path 126*a* may be discharged through the second oil hole 128*b* and supplied to the upper surface of the eccentric portion 126*f* Hence, the oil may be discharged through the third oil hole 128*d* and supplied to the entire area of the outer circumferential surface of the eccentric portion 126*f*.

The oil guided to the upper area along the oil supply path 126*a* may be discharged through the fourth oil hole 128*e* and supplied to the outer circumferential surface of the sub bearing 126*g* or between the orbiting scroll 140 and the fixed scroll 150.

An oil feeder 171 may be coupled to a lower end of the shaft 126, in other words, a lower end of the sub bearing 126*g* to pump the oil filled in the fourth space V4. The oil feeder 171 may be configured to supply the oil stored in the fourth space V4 to the oil holes 128*a*, 128*b*, 128*d* and 128*e*.

The oil feeder 171 may include an oil supply pipe insertedly coupled to the oil supply path 126*a* of the shaft 126; and an oil absorptive member 174 inserted in the oil supply pipe 173 and configured to absorb the oil.

The oil supply pipe 173 may be wound around the fourth space V4 after penetrating the through-hole 176 of the discharge cover 170. The oil absorptive member 174 may function as a propeller.

The oil absorptive member 174 may include a spiral groove 174*a* extending along a longitudinal direction of the oil absorptive member 174. The spiral groove 174*a* ma be formed in a rim of the oil absorptive member 174 and extending towards the above-noted oil holes 128*a*, 128*b*, 128*d* and 128*e*.

When the oil feeder 171 is rotated together with the shaft 126, the oil stored in the fourth space V4 may be guided to the oil holes 128*a*, 128*b*, 128*d* and 128*e* along the spiral groove 174*a*.

A balance weight 127 may be coupled to the rotor 124 or the shaft 126 to suppress noise vibration. The balance weight 127 may be provided in the second space V2 formed between the drive motor 120 and the compression part 100.

Next, the operation of the scroll compressor according to one embodiment of the present disclosure will be described as follows.

When the rotational power is generated by the power applied to the drive motor 120, the shaft 126 coupled to the rotor 124 of the drive motor 120 may be rotated. While the orbiting scroll 140 eccentrically coupled to the shaft 126 may orbit with respect to the fixed scroll 150, the compression chamber S1 may be formed between the orbiting scroll wrap 141 and the fixed scroll wrap 151. The compression chamber S1 may be formed in several steps serially, while the volume of the compression chamber S1 is getting narrower towards the center.

Hence, the refrigerant supplied via the refrigerant suction pipe 118 from the outside of the case 110 may be directly drawn into the compression chamber S1. The refrigerant may be compressed while being moved to the discharge chamber of the compression chamber S1 by the orbiting movement of the orbiting scroll 140 and discharged to the third space V3 via the discharge hole 153 of the fixed scroll 150 from the discharge chamber.

After that, the compressed refrigerant discharged to the third space V3 may be discharged to the inner space of the case 110 via the fixed scroll discharge hole 155*a* and the frame discharge hole 131*a* and then discharged to the outside of the case 110 via the refrigerant discharge pipe 116. The refrigerant may repeat the above series of the processes.

While the compressor is operating, the oil stored in the fourth space V4 may be guided upwardly through the shaft 126 and smoothly supplied to the bearing, in other words, the bearing surface via the plurality of the oil holes 128*a*, 128*b*, 128*d* and 128*e*. Accordingly, the wearing of the bearing may be prevented.

In addition, the oil discharged via the plurality of the oil holes 128*a*, 128*b*, 128*d* and 128*e* may form an oil film between the fixed scroll 150 and the orbiting scroll 140 so as to keep the sealed state of the compression part.

Such the oil may be mixed with the refrigerant compressed in the compression part 100 and then discharged to the first discharge hole 153. Hereinafter, for easy description sake, the refrigerant mixed with the oil may be referred to as "the oil mixed refrigerant".

Such the oil-mixed refrigerant may be guided to the first space V1 after passing the second discharge hole 131*a*, 155*a*, the second space V2 and the refrigerant path groove 112*a*. The refrigerant of the oil mixed refrigerant may be discharged to the outside of the compressor via the refrigerant discharge pipe 116 and the oil thereof may be collected in the fourth space V4 through the oil recovery path 112*b*.

As one example, the oil recovery path 112*b* may be arranged in the outermost area in a radial direction in the case 110. Specifically, the oil recovery path 112*b* may include a path between an outer circumferential surface of the stator 122 and an inner circumferential surface of the cylindrical shell 111, a path between an outer circumferential surface of the main frame 130 and an inner circumferential surface of the cylindrical shell 111, and a path between an outer circumferential surface of the fixed scroll 150 and an inner circumferential surface of the cylindrical shell 111.

Meanwhile, as the discharge cover 170 is coupled to the lower end of the compression part 100, there might be a minute gap between a lower end and an upper end of the discharge cover 170. Such a minute gap could cause refrigerant leakage.

In other words, when the refrigerant discharged to the third space V3 through the first discharge hole 153 of the compression part 100 is guided to the second discharge hole 131*a* and 155*a*, some of the refrigerant might leak to the gap that is likely to occur between the compression part 100 and the discharge cover 170.

In addition, such the refrigerant leakage might deteriorate the compression efficiency of the compressor disadvantageously. Such a problem may be solved by the sealing member 210 and 220 provided between the compression part 100 and the discharge cover 170 (in other words, the coupling portion between the compression part 100 and the discharge cover 170) and the coupling structure between the compression part 100 and the discharge cover 170.

Hereinafter, referring to FIG. 2, the fixed scroll wrap 151 of the fixed scroll and the orbiting scroll wrap 141 of the orbiting scroll 140 will be described in detail.

Figure 2:
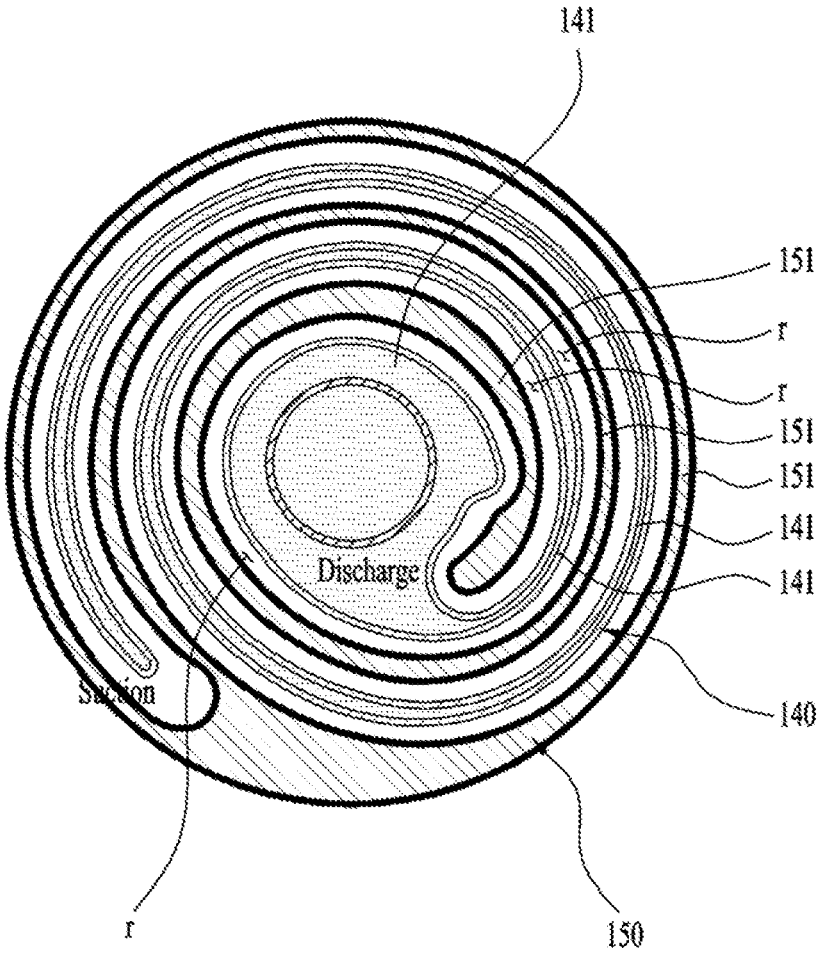
FIG. 2 is a plane view illustrating a wrap cross section of fixed and orbiting scrolls.

FIG. 2 illustrates a horizontal cross-sectional view of a state where the fixed scroll wrap 151 of the fixed scroll and the orbiting scroll wrap 141 of the orbiting scroll 140 are not in contact with each other. However, the fixed scroll and the orbiting scroll are not located as shown in FIG. 2 actually. That is shown to intuitively recognize the shapes of the fixed scroll wrap 151 and the orbiting scroll wrap 141 and the wrap profile.

When the refrigerant is drawn from an outer area with respect to a radial direction of the fixed scroll and the orbiting scroll, the refrigerant may get compressed towards the outer area with respect to the radial direction and the compressed refrigerant may be discharged from the centers of the fixed scroll and the orbiting scroll.

As shown in the drawing, the thicknesses or profiles of the fixed scroll wrap 151 and the orbiting scroll wrap 141 may not be uniform. However, a distance between the fixed scroll wrap 151 and the orbiting scroll wrap 141, in other words, an orbiting radius r may be uniform.

Figure 3:
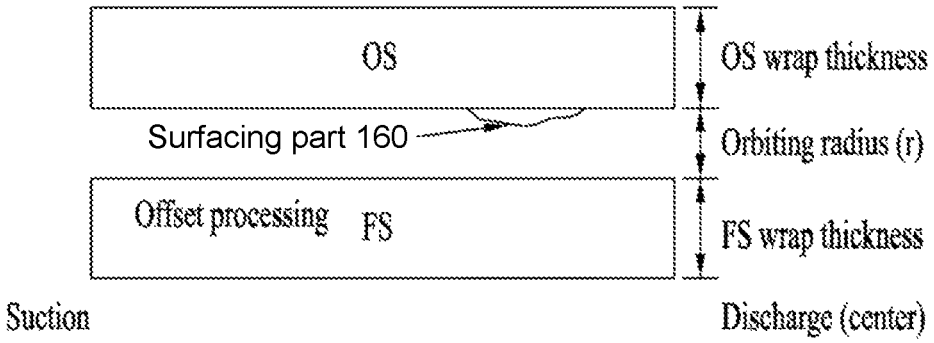
FIG. 3 is a schematic diagram illustrating a wrap thickness and an orbiting radius in a state where an orbiting scroll wrap and a fixed scroll wrap are spread.

It may be schematically shown in FIG. 3 that the rolled fixed scroll wrap and orbiting scroll wrap are unrolled. In other words, the wraps may be unrolled to keep the uniform distance between the fixed scroll wrap and the orbiting scroll wrap, in other words, the uniform orbiting radius r. As the orbiting scroll wrap is orbiting with respect to the fixed scroll wrap actually, an orbiting angle of the orbiting scroll may vary and the distance to the orbiting scroll wrap from the fixed scroll wrap may vary. Accordingly, the fixed scroll wrap and the orbiting scroll wrap may be designed and fabricated to have the variable thicknesses so as to have such the same orbiting radius.

In addition, as the orbiting angle of the orbiting scroll wrap varies, the number and position of the contact point between the fixed scroll wrap and the orbiting scroll wrap may vary. When there is one contact point between the fixed scroll wrap and the orbiting scroll wrap, the centrifugal force or pressure at the one contact point may become very large. Especially, when such the contact point is formed in a relatively thin area of the wrap, there might be a concern of wrap breakage.

In this instance, the number of the contact points may be variable based on the orbiting angle of the orbiting scroll wrap. However, four or more contact points may be generated and the centrifugal force may be dispersed. Nevertheless, there is one of the contact points where the centrifugal force or pressure is relatively concentrated and such the concentration of the centrifugal force or pressure may occur in the area having a relatively thin wrap. Especially, when the compressor is operated at a high speed, there is always a concern of wrap breakage in the centrifugal force or pressure concentrated point.

As shown in FIG. 3, a surfacing part may be added to the orbiting scroll wrap and/or fixed scroll wrap positioned at a specific location and the orbiting radius at the surfacing part location may be reduced. In this instance, the location of the surfacing part has no relation with the wrap thickness and the centrifugal force or pressure concentration location. In other words, the location of the surfacing part may not be the location where the wrap thicknesses are relatively the smallest nor the location where the centrifugal force is largely concentrated.

As mentioned above, the number and location of the contact points are variable as the orbiting angle of the orbiting scroll wrap is variable. Accordingly, the contact may occur and the dispersion ratio of the centrifugal force generated between the orbiting scroll wrap and the fixed scroll wrap at another contact point may vary. As a result, it may be important to consider the possibility of the centrifugal force dispersion generated by the surfacing and set the optimal location of the surfacing.

Figure 4:
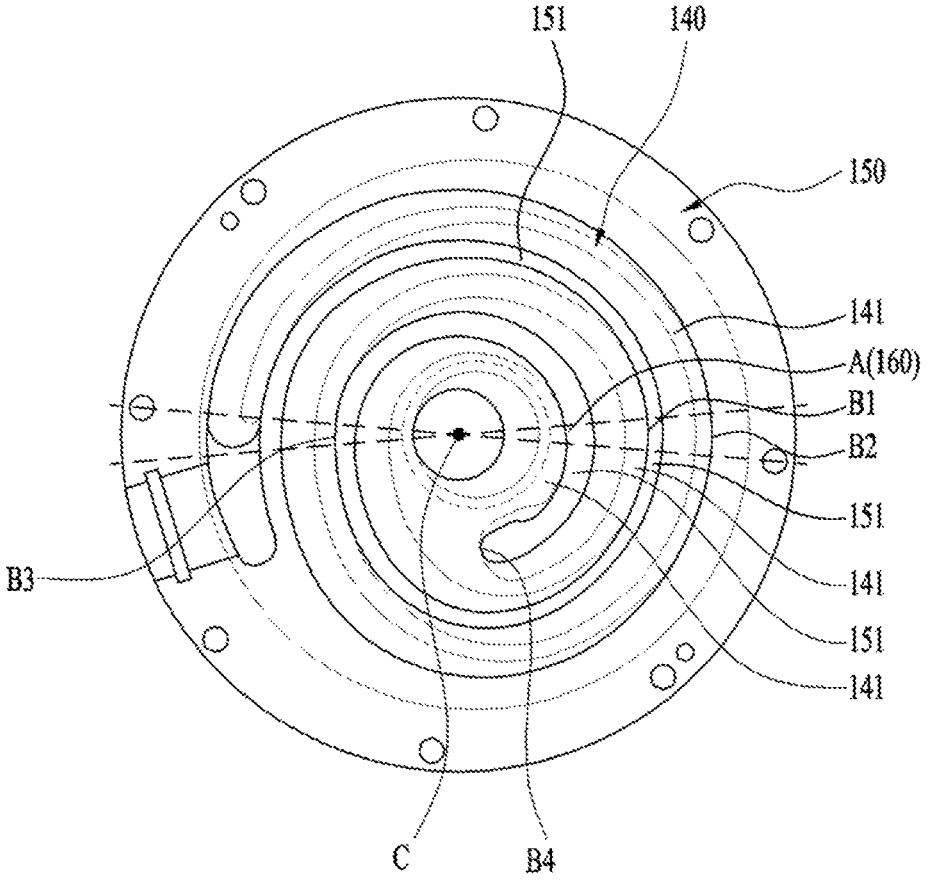
FIG. 4 is a plane view illustrating one example of a contact point and a contact area between an orbiting scroll wrap and a fixed scroll wrap based on a surfacing part.

Referring to FIG. 4, the location of the orbiting scroll wrap contact point and contact area with the fixed scroll wrap as the orbiting scroll is orbiting will be described in detail. FIG. 4 illustrates a contact point location and area when the orbiting angle of the orbiting scroll is approximately 180 degree.

As the eccentric portion 126*f* provided in the shaft 126 is coupled to the orbiting scroll 140, the orbiting scroll may be orbiting with eccentricity with respect to the rotation center C of the shaft. The orbiting scroll wrap 141 and the fixed scroll wrap 151 at the shown angles may have five contact points A and B1 through B4.

A is a contact point that is formed in the innermost area with respect to the radial direction and between an outer surface of the orbiting scroll wrap in the radial direction and an inner surface of the fixed scroll wrap in the radial direction. Also, A may be a contact point that is formed in the innermost area with respect to the radial direction. B1 and B2 are the contact points that are formed in an outer area in the radial direction with respect to A. B2 is a contact point that is formed in the outermost area in the radial direction. Also, B1 and B2 are the contact points that are formed between the radial-direction outer surface of the orbiting scroll wrap and the radial-direction inner surface of the fixed scroll wrap.

B3 is the contact point that is formed between the radial-direction inner surface of the orbiting scroll wrap and the radial-direction outer surface of the fixed scroll wrap, different from B1 and B2. B4 is the contact point that is formed in a radial-direction inner end of the fixed scroll wrap.

As shown in the drawing, the thicknesses of the orbiting and fixed scroll wraps tend to become thinner as getting closer to the radial-direction outer area. Accordingly, when a strong power is applied to the orbiting or fixed scroll wrap in the radial-direction outer area, there might be a concern of breakage. Especially, the centrifugal force may be generated at the contact point between the orbiting scroll wrap that is eccentrically orbiting and the fixed scroll wrap. During the high-speed operation, a quite a strong power is applied to the contact point.

The thicknesses of the wraps may be the largest at B4 contact point. Accordingly, the centrifugal force concentration at B4 contact point has to be considered. However, it is preferred that the centrifugal force is not concentrated on B1 and B2 contact points, especially, B2 having thin wrap thicknesses.

As shown in the drawing, the contact point is not one point but a curve having a predetermined area. The wrap is formed as the curve and the curvature radius is getting larger towards the radial-direction outer area. Because of that, the areas of the contact points may become larger as closer to the radial-direction outer area.

Meanwhile, the direct contact between the orbiting scroll wrap and the fixed scroll wrap may be limited physically. That is because the orbiting and fixed scroll wraps formed of metal are not preferred to directly contact with each other only to cause friction. Accordingly, a lubricant film may be formed between the orbiting scroll wrap and the fixed scroll wrap and the orbiting scroll may be orbiting with respect to the fixed scroll to maintain such a lubricant film.

The thickness t of the lubricant film may be set to be approximately 20 μm or less.

Specifically, when the distance between the orbiting scroll wrap and the fixed scroll wrap is approximately 20 μm, such a point may be set as the contact point.

As shown in the drawing, a surfacing part 160 may be formed at A contact point. The surfacing part 160 may be formed between the radial-direction outer surface of the orbiting scroll wrap and the radial-direction inner surface of the fixed scroll wrap. The surfacing part 160 may be formed in each of the wraps facing each other or one of them. The orbiting radius may become narrower by such the surfacing part 160.

When the thickness t1 of the surfacing part 160 is approximately 10 μm, the contact area at A may increase. In other words, the distance between the fixed scroll wrap and the orbiting scroll wrap may become smaller. In contrast, the contact areas at the contact points of B1, B2 and B3 may decrease. In other words, the distance between the fixed scroll wrap and the orbiting scroll wrap may become larger and farther, corresponding to the thickness of the surfacing part.

When described easily, the distance of the orbiting scroll wrap that is eccentric to the right may be decreased as far as the thickness of the surfacing part 160. Accordingly, the contact area may increase in the area where the surfacing part is provided and decrease in the area without the surfacing part.

In this instance, the relation between the wrap thicknesses, the contact point location and the surfacing part is shown. When the surfacing part is formed in the contact point having the thick wraps (the radial-direction inner area), the contact area may increase at the contact point having the relatively thick wraps (the radial-direction outer area). In other words, the contact area may be increased in the area with the thick wraps and decreased at the area with the thin wraps.

Considering the thickness t of the lubricant film, the thickness t1 of the surfacing part has to be set properly. When the thickness of the surfacing part is larger than that of the lubricant film, the lubricant film is likely to break enough to cause the direct contact between the wraps disadvantageously. Accordingly, considering the margin of the lubricant film, the thickness of the surfacing part may be set to be 0.5 times or less of the lubricant film thickness. The thickness of the surfacing part has to be a meaningful thickness such that it may be set to be more than 0 μm and less than 10 μm, when the thickness of the lubricant film is approximately 20 μm.

The relation of the contact area between the surfacing part and the contact points is described in detail.

Hereinafter, referring to FIGS. 5 and 6, the dispersion of the centrifugal force concentration performed by the surfacing part will be described in detail.

Figure 5:
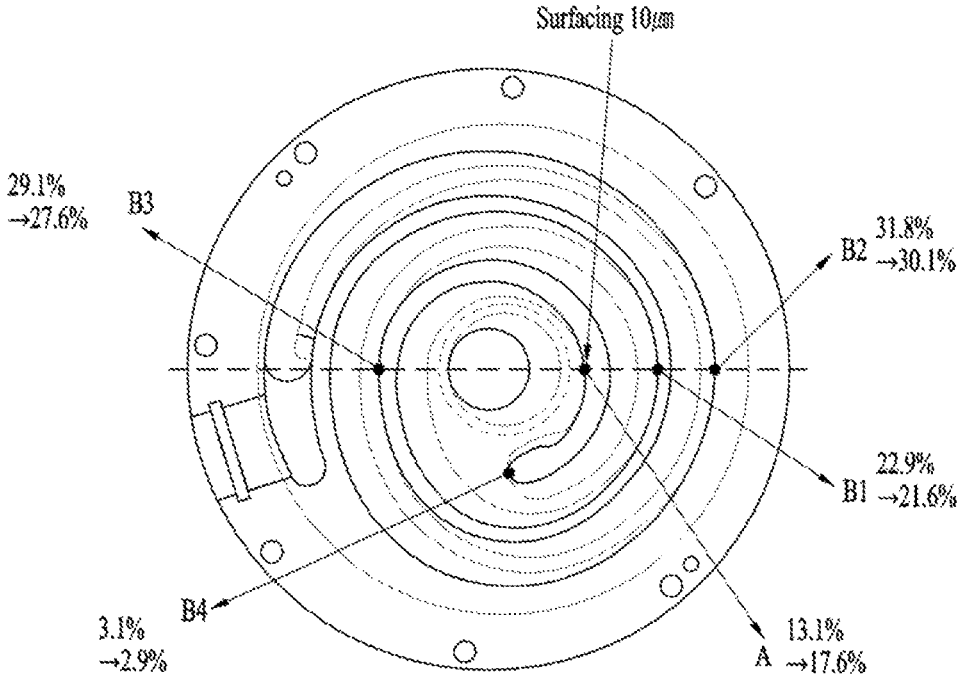
FIG. 5 is a plane view illustrating one example of a position of the surfacing part and a centrifugal force concentration degree in an orbiting angle section that has five contact points.

As shown in FIG. 5, there are five contact points between the orbiting scroll wrap and the fixed scroll wrap when the orbiting angle of the orbiting scroll is approximately 0~260 degrees. A dispersion degree of the centrifugal force is shown at the five contact points formed between the conventional orbiting and fixed scrolls (when the orbiting angle is approximately 170 degrees).

It is shown that the dispersion degree is 13.1% at A, 22.9% at B1, 31.8% at B2, 29.1% at B3 and 3.1% at B4. Specifically, the centrifugal force is most concentrated on B3 having the thinnest wraps. Because of that, it is relatively more likely that the fixed scroll wrap or the orbiting scroll wrap breaks at B3.

Such the problem may be solved by providing the surfacing part at a specific location.

First of all, B4 contact point may be the radial-direction inner end of the fixed scroll wrap such that it may require no surfacing part, considering the thickness and the centrifugal force dispersion degree.

The surfacing part may be formed at A contact point that is formed in the radial-direction innermost area out of the contact points except such the end area located point. As one example, the surfacing part having the thickness of 10 μm may be formed in consideration of the lubricant film thickness.

At this time, the contact area increases at A contact point and a more centrifugal force concentration may occur. In other words, the centrifugal force concentration of 17.6% may occur, increasing from 13.1%. However, although the centrifugal force generated at A contact point increases, such increase of the centrifugal force concentration may be allowable in consideration of the wrap thickness at the contact point and the centrifugal force concentration degree that is allowed to occur in the entire wrap area.

The centrifugal force concentration at B1 contact point decreases to 21.6% from 22.9% and to 30.1% from 31.8% at B2 contact point. It decreases to 27.6% from 29.1% at B3 contact point.

The maximum centrifugal force concentration may decrease to 30.1% from 31.8%. That may be considered when setting the thicknesses of the orbiting scroll wrap and the fixed scroll wrap. In other words, as the maximum centrifugal force concentration is getting decreased, the orbiting scroll and the fixed scroll may be getting smaller. In addition, the margin rate may become larger when the scrolls have the same size such that reliability and durability may be noticeably enhanced. For easy description, a strong power may be applied to the strong area and a less strong power may be applied to a weak area.

Figure 6:
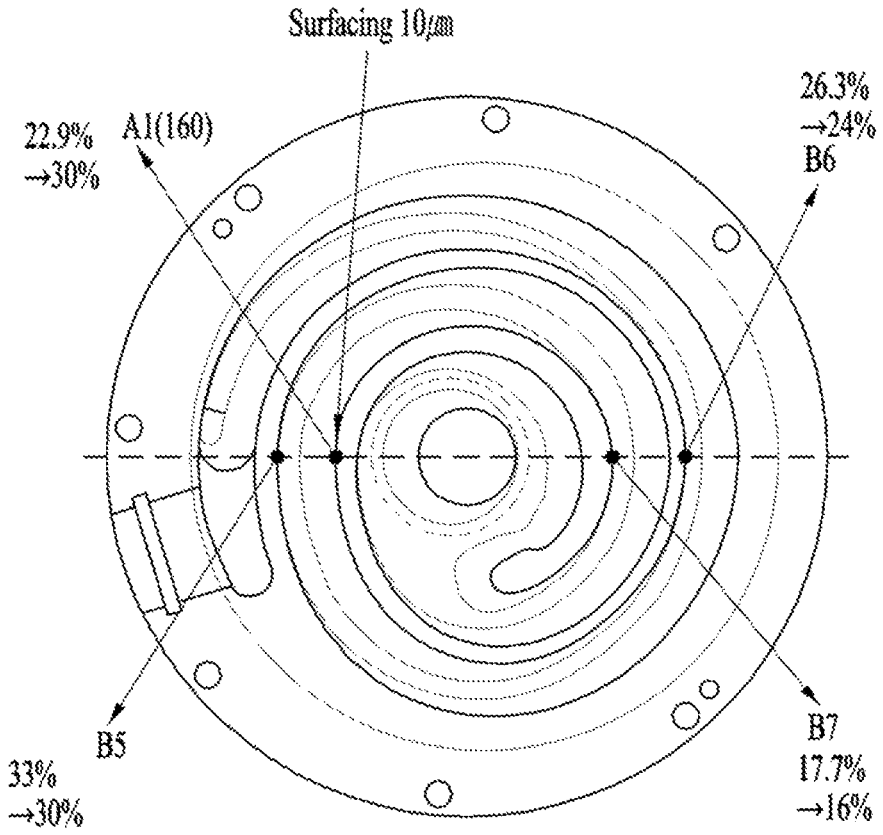
FIG. 6 is a plane view illustrating one example of a position of the surfacing part and a centrifugal force concentration degree in an orbiting angle section that has four contact points.

As shown in FIG. 6, there may be four contact points between the orbiting scroll wrap and the fixed scroll wrap at the orbiting angle of the orbiting scroll between 270 degrees and 360 degrees. The dispersion degree of the centrifugal force at the four contact points formed between the conventional orbiting and fixed scrolls (when the orbiting angle is approximately 350 degrees) is shown in the drawing.

The dispersion degree of the centrifugal force centration is 22.9% at A1, 33% at B5, 31.8% at B2, 26.3% at B6 and 17.7% at B7. In other words, the centrifugal force is most concentrated at B5 or B6 that have the thinnest wraps. Because of that, it is relatively more likely that the fixed or orbiting scroll wrap breaks at B5 or B6. Especially, in the section of the orbiting angles in which four contact points are formed, not five contact points, the areas where the centrifugal force is dispersed may be decreased. Accordingly, the centrifugal force generated in one contact point may become stronger. At this time, when the concentration of the centrifugal force is generated at one contact point, that might be a big problem in comparison with the five contact points.

Such the problem may be solved by locating the surfacing part 160 in a specific position.

First of all, the surfacing part 160 may be formed at A1 contact point that is located in the radial-direction innermost area out of the contact points. Accordingly, the contact area at A1 may increase.

In contrast, the contact areas may decrease at B5, B6 and B7. Accordingly, the surfacing part may be formed in A1 to support the more centrifugal force at A1.

While the centrifugal force concentration may increase to 30% from 22.9% at A1, the centrifugal force concentration may decrease to 30% from 33% at B5 and to 24% from 26.3% at B6 and to 16% from 17.7% at B7.

In other words, the centrifugal force concentration increases at the area having the thick wraps to decrease the centrifugal force concentration in the area having the thin wraps. Accordingly, the maximum centrifugal force concentration may decrease to 30% from 33%.

Accordingly, the surfacing part may be formed in a predetermined section of the entire orbiting scroll wrap and/or fixed scroll wrap section according to one embodiment such that the centrifugal force concentration can be dispersed. Especially, the surfacing part may be formed in the wrap that is located in the radial-direction inner area and the centrifugal force concentration on the surfacing part may be increased, such that the centrifugal force concentration on the wrap located in the radial-direction outer area may be reduced. Accordingly, the surfacing part may be provided in the radial-direction innermost area and formed in the orbiting scroll wrap having a closed curve surrounding the center C of the shaft and the fixed scroll wrap corresponding to such the orbiting scroll wrap. In addition, no surfacing part may be formed in the radial-direction end area of the fixed scroll wrap and the corresponding orbiting scroll wrap. That is because the contact in this area is changed gently as the orbiting scroll wrap is orbiting.

Meanwhile, the curvature radius of the wrap may become smaller towards the radial-direction inner areas. Accordingly, it is possible to make the section of the surfacing part smaller.

The thickness of the surfacing part may become thicker from both ends towards the center. Accordingly, the lubricant film may be maintained in the surfacing part and the gentle orbiting may be performed.

As mentioned above, the surfacing part may be applied to the orbiting angle section in case of the five contact points and in case of the four contact points. As the orbiting angle of the orbiting scroll varies, the size of the centrifugal force may vary.

As one example, when the orbiting angle is 40 degrees, the centrifugal force may be 3790N. When the orbiting angle is 170 degrees, the centrifugal force may be 2530. When the angle is 240 degrees, the centrifugal force may be 3310N. When the orbiting angle is 350 degrees, the centrifugal force may be 3500N.

Specifically, if the same centrifugal force concentration (as one example, 25% of the centrifugal force) is concentrated at a specific location, the entire centrifugal force may become stronger and the centrifugal force supporting the specific location may then become stronger.

Accordingly, it is preferred that the position of the surfacing part is set, considering the variation of the contact point number based on the orbiting angle and the variation of the entire centrifugal force based on the orbiting angle. As a result, it is optimal that the surfacing part is formed in the section of the orbiting angles from 270 degrees to 350 degrees.

The above-noted section of the orbiting angles may not include 260 degrees to 270 and 350 to 360 degrees (0 degree). In such the angle section, the number of the contact points is not clearly determined to be four or five. Accordingly, the orbiting angle section may be flexibly variable based on the definition of the contact points (the distance between the orbiting scroll wrap and the fixed scroll wrap) and the allowable thickness of the lubricant film.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A compressor comprising:

an orbiting scroll having an orbiting scroll wrap;

a fixed scroll having a fixed scroll wrap; and a protrusion that is disposed at the orbiting scroll wrap or the fixed scroll wrap and that reduces a distance between the orbiting scroll wrap and the fixed scroll wrap, wherein the orbiting scroll and the fixed scroll are configured to, based on the orbiting scroll orbiting with respect to the fixed scroll, define a plurality of contact points between the orbiting scroll wrap and the fixed scroll wrap, and wherein the protrusion is disposed at an innermost contact point of the plurality of the contact points that is located at an innermost area in the radial direction, and wherein the protrusion has a thickness that is smaller than a thickness of a lubricant film that is disposed at the contact points between the orbiting scroll wrap and the fixed scroll wrap.

2. The compressor of claim 1, wherein the distance between the orbiting scroll wrap and the fixed scroll wrap is uniform except for an area including the protrusion and areas at ends of the orbiting scroll wrap and the fixed scroll wrap.

3. The compressor of claim 1, wherein the orbiting scroll and the fixed scroll are configured to make four or five contact points between the orbiting scroll wrap and the fixed scroll wrap based on the orbiting scroll orbiting with respect to the fixed scroll.

4. The compressor of claim 3, wherein an orbiting angle of the orbiting scroll has (i) a first range in which the four contact points are made between the orbiting scroll wrap and the fixed scroll wrap and (ii) a second range in which the five contact points are made between the orbiting scroll wrap and the fixed scroll wrap.

5. The compressor of claim 4, wherein a contact area at one of the contact points that is located closer, in a radial direction, to an outermost area than the other contact points is larger than contact areas at the other contact points.

6. The compressor of claim 4, wherein the second range of the orbiting angle of the orbiting scroll are from 0 degree to 260 degree, and wherein the first range of the orbiting angle of the orbiting scroll are from 270 degrees to 350 degrees.

7. The compressor of claim 4, wherein the protrusion is disposed at one of the four contact points based on the orbiting angle being in the first range.

8. The compressor of claim 7, wherein one of the four contact points that is located, in a radial direction, at an outermost area has a largest contact area of the four contact points.

9. The compressor of claim 7, wherein the protrusion is disposed at one of the four contact points except for a first contact point, the first contact point having a largest contact area of the four contact points.

10. The compressor of claim 7, wherein the protrusion is disposed at one of the four contact points that has a smallest contact area of the four contact points.

11. The compressor of claim 1, wherein the thickness of the protrusion is half or less than half of the thickness of the lubricant film.

12. The compressor of claim 1, wherein, based on the thickness of the lubricant film being 20 μm, the thickness of the protrusion is less than 10 μm.

13. The compressor of claim 1, wherein the protrusion is disposed at either the fixed scroll wrap or the orbiting scroll wrap.

14. A compressor comprising:

an orbiting scroll having an orbiting scroll wrap;

a fixed scroll having a fixed scroll wrap; and a protrusion that is disposed at the orbiting scroll wrap or the fixed scroll wrap and that reduces a distance between the orbiting scroll wrap and the fixed scroll wrap, wherein the orbiting scroll wrap and the fixed scroll wrap have thicknesses that at least partially vary, and wherein the distance between the orbiting scroll wrap and the fixed scroll warp is constant except for an area including the protrusion.

* * * * *